US005758833A

United States Patent [19]

Kabbe

[11] Patent Number: 5,758,833

[45] Date of Patent: Jun. 2, 1998

[54] AGITATOR MILL

[75] Inventor: Hans Kabbe, Schriesheim, Germany

[73] Assignee: Draiswerke GmbH, Mannheim, Germany

[21] Appl. No.: 701,797

[22] Filed: Aug. 26, 1996

[30] Foreign Application Priority Data

Jul. 26, 1996 [DE] Germany ..... 196 30 186.6

[51] Int. Cl.[6] ..... B02C 17/16

[52] U.S. Cl. ..... 241/79.2; 241/171; 241/179; 241/285.3

[58] Field of Search ..... 241/46.17, 69, 241/79, 79.2, 98, 171, 179, 285.3

[56] References Cited

U.S. PATENT DOCUMENTS

| | | | |
|---|---|---|---|
| 1,321,540 | 11/1919 | McCool | 241/285.3 X |
| 1,706,643 | 3/1929 | Wiley | 241/285.3 X |
| 3,135,474 | 6/1964 | Schold | 241/171 X |
| 3,780,957 | 12/1973 | Wilhelm | 241/172 |
| 3,844,490 | 10/1974 | Schold et al. | 241/171 X |
| 4,054,292 | 10/1977 | Stone | 241/179 X |
| 4,739,936 | 4/1988 | Stehr | 241/69 |
| 4,754,934 | 7/1988 | Ikebuchi et al. | 241/171 X |
| 4,784,336 | 11/1988 | Lu | 241/171 X |
| 4,850,541 | 7/1989 | Hagy | 241/171 |
| 5,544,825 | 8/1996 | Stehr | 241/171 |
| 5,624,080 | 4/1997 | Stehr et al. | 241/171 X |

FOREIGN PATENT DOCUMENTS

| | | | |
|---|---|---|---|
| 2 529 473 | 1/1984 | France | 241/171 |
| 43 16 301 | 12/1993 | Germany | 241/171 |

OTHER PUBLICATIONS

Leaflet "Dyno–Mill", Typ KD 120A/190A/280A, A. Bachofen AG Maschinenfabrik of CH–4005 Basel/Switzerland, publication No. 4912/057112, (No Date Given).

*Primary Examiner*—John M. Husar
*Attorney, Agent, or Firm*—Browdy and Neimark

[57] ABSTRACT

An agitator mill comprises a grinding receptacle with a cylindrical inside wall which is free from any openings whatsoever. All the openings needed for operation, in particular a separating device joined to a grinding-stock discharge line and, if required, a refill opening for auxiliary grinding bodies, are disposed in a bottom which is releasably connected with the grinding receptacle.

42 Claims, 11 Drawing Sheets

AGITATOR MILL

BACKGROUND OF THE INVENTION

1. Field of the Invention

The invention relates to an agitator mill comprising a grinding receptacle, of which a cylindrical wall and a lid and a bottom define a grinding chamber to be filled with auxiliary grinding bodies, an agitator, which is disposed in the grinding receptacle, and which has an agitator shaft overmounted outside of the grinding chamber and ending in a free end inside the grinding chamber, and agitator elements mounted on the agitator shaft, a drive motor driving the agitator in rotation about an axis, a grinding-stock supply line disposed at least in vicinity to the lid of the grinding receptacle and opening into the grinding chamber, and a separating device disposed in the bottom, a grinding-stock discharge line connected to the separating device, and a device for the releasable connection of the bottom with the grinding receptacle.

2. Background Art

The leaflet "DYNO-MILL" Typ KD 120 A/190 A/280 A of the company A. Bachofen AG Maschinenfabrik of CH-4005 Basel/Switzerland (publication no. 4912/057112) teaches an agitator mill with a grinding receptacle of horizontal arrangement, in which an agitator is disposed coaxially, the agitator being rotatable by a drive motor. In a bottom of the grinding receptacle provision is made for a separating device in the form of a screen box, which is situated between the free end of the agitator and a plane bottom plate. In addition to the closing plate, the bottom has an annular section, in which the separating device is arranged. Opening the bottom is accompanied with some effort. Moreover, dead spaces may form between the screen box and the bottom plate, which may lead to difficulties, depending on the kind and especially on the viscosity of the grinding stock.

SUMMARY OF THE INVENTION

It is one object of the invention to embody an agitator mill of the type specified above so as to make it especially convenient to operate and clean.

This object is solved by the invention. Due to the fact that the entire cylindrical inside wall of the grinding receptacle is free from openings and connections, cleaning can be done very easily. All the openings needed in operation for discharging grinding stock and, as the case may be, auxiliary grinding bodies are formed in the bottom. The fact that a hinge arrangement permitting the bottom to be pivoted off the grinding receptacle and a closing mechanism for the releasable connection of the bottom with the grinding receptacle are provided between the grinding receptacle and the bottom facilitates the opening of the grinding receptacle and thus of the grinding chamber, which is of advantage in particular for cleaning purposes.

If the bottom comprises a lid-type closing piece and a ring section, which partly surrounds the separating device and is disposed between the closing piece and the grinding receptacle, this permits especially easy opening and cleaning, which is even more facilitated by the special design according to which the lid-type closing piece and the ring section are joined to the grinding receptacle each by means of pivot links that are separate from each other, and according to which the two pivot links are formed as a double hinge arrangement. In particular when used in agricultural chemicals industry, this special design in conjunction with the design according to which a sealing face and a seal are provided at least between the bottom and the grinding receptacle, and according to which a sealing face and a seal are provided between the lid-type closing piece and the ring section, is very much of use, especially thorough cleaning being rendered possible, which is accompanied with convenient accessibility of the sealing faces and seals.

If screen cartridges are provided on both sides of the agitator shaft, provision can also be made for the agitator shaft to comprise an annexed piece, which passes between the screen cartridges in the direction towards the lid-type closing piece and on which is mounted a circulation disk disposed between the lid-type closing piece and the screen cartridges, which helps attain rinsing all over the screening face of the screen cartridges. As a result, there is no agglomeration of auxiliary grinding bodies on the screen cartridges leading to increased pressure in the grinding chamber and/or to increased wear. In particular when such a circulation disk is provided, it is of advantage for the lid-type closing piece to be in the form of a bottom cup and in particular a dished head, the diameter ratio, according to which the diameter of the circulation disk is smaller than the diameter of the agitator elements, ensuring that there is especially little space additionally required for the circulation disk, which makes the closing piece especially easy to clean. It must be added that configuring the bottom as a dished head can be also be used in agitator mills having openings in their cylindrical wall defining a grinding chamber.

The embodiment comprising the pivot links, and in particular the double hinge arrangement, can be used by advantage when a screen cartridge disposed with its front towards the agitator is provided as a separating device.

In the ring section, provision can also be made for an auxiliary grinding body outlet through which the auxiliary grinding bodies are returned via an auxiliary grinding body return line to the supply portion of the grinding chamber. Related to the axis, the auxiliary-grinding-body outlet is disposed radially to the agitator element which is next to the separating device.

A closable refill opening for auxiliary grinding bodies can be provided in the bottom.

Further features, advantages and details of the invention will become apparent from the ensuing description of exemplary embodiments, taken in conjunction with the drawing.

DESCRIPTION OF THE PREFERRED EMBODIMENTS

Figure 1:
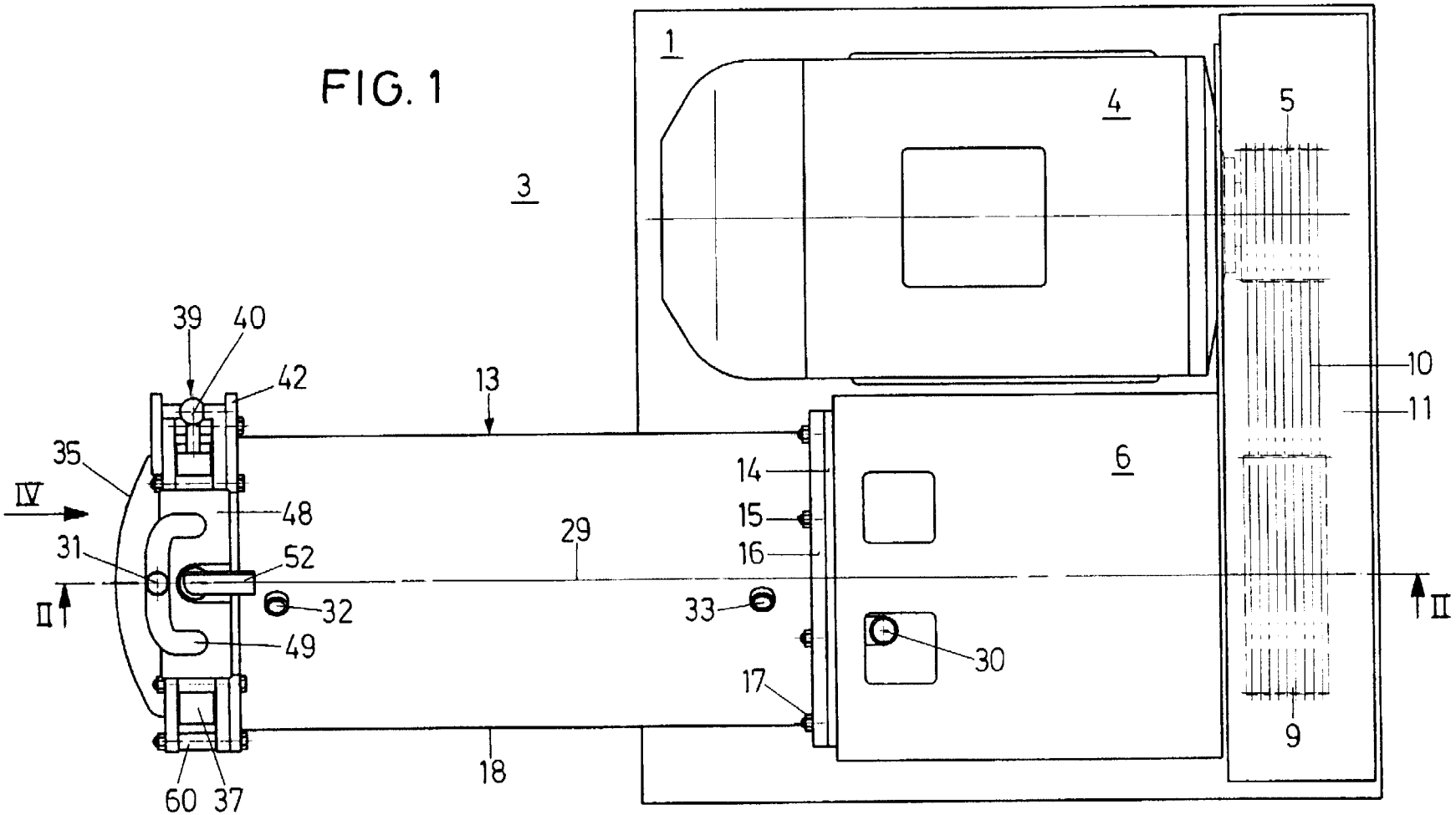
FIG. 1 is a plan view of a first embodiment of an agitator mill according to the arrow I of FIG. 2.
Figure 2:
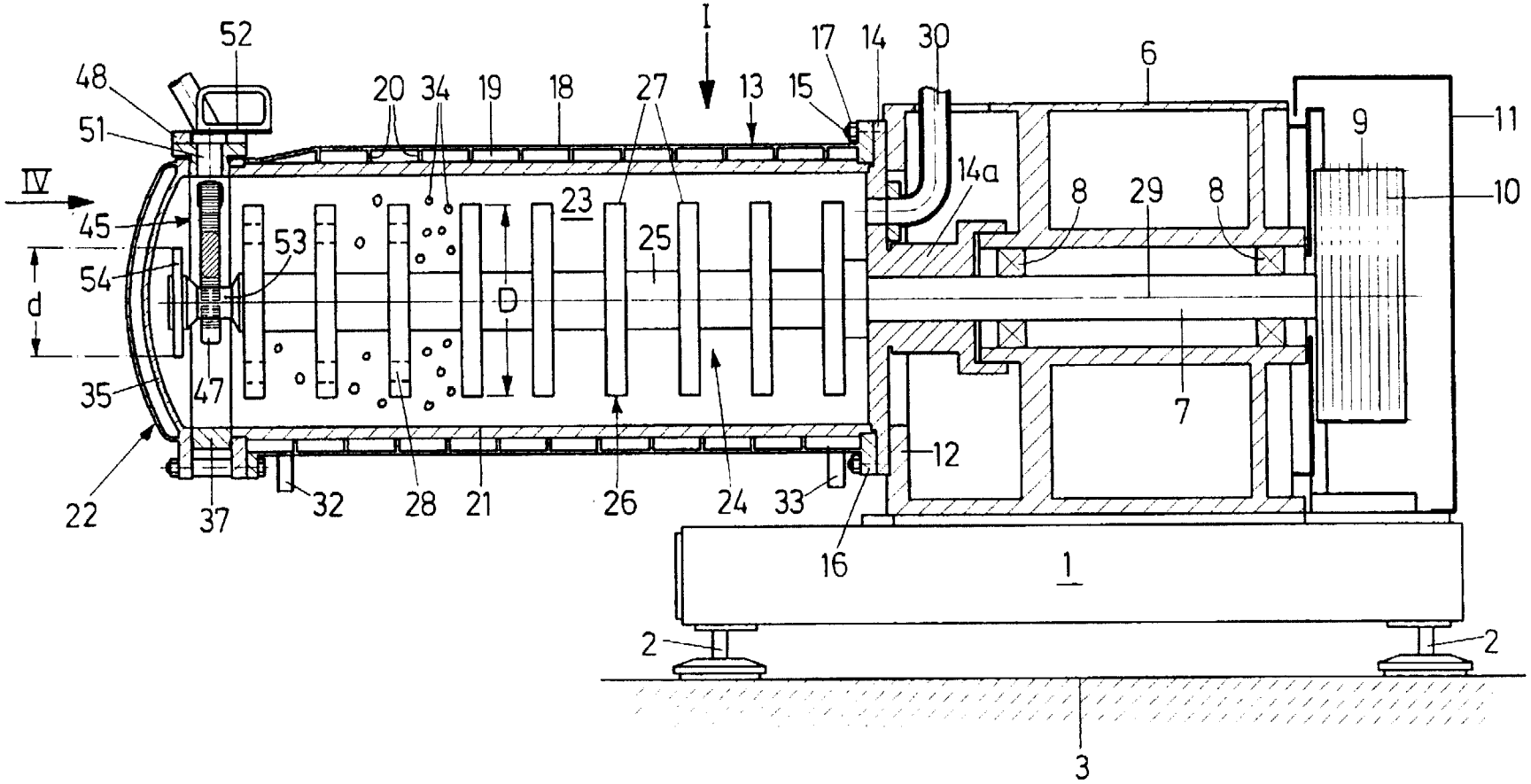
FIG. 2 is a vertical section of the agitator mill according to the section line II—II of FIG. 1.
Figure 3:
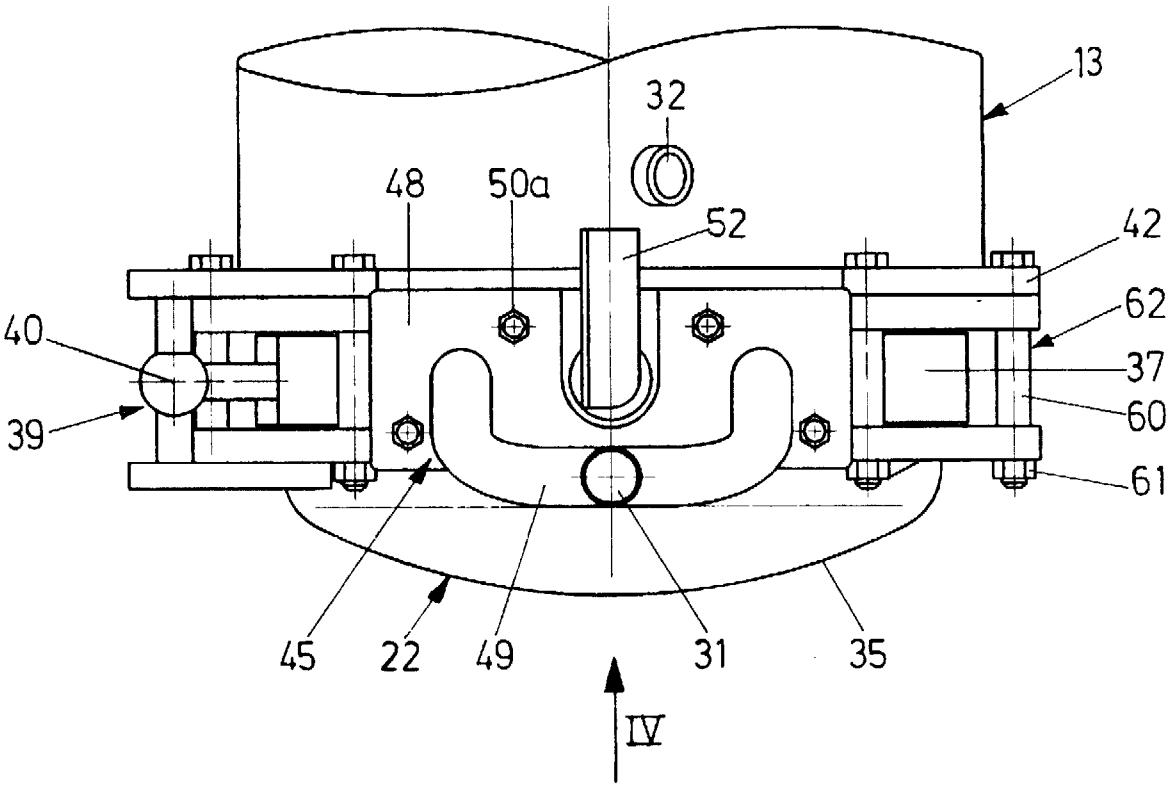
FIG. 3 is a plan view, on an enlarged scale as compared to FIG. 1, of the bottom of the agitator mill according to the arrow I of FIG. 2.
Figure 4:
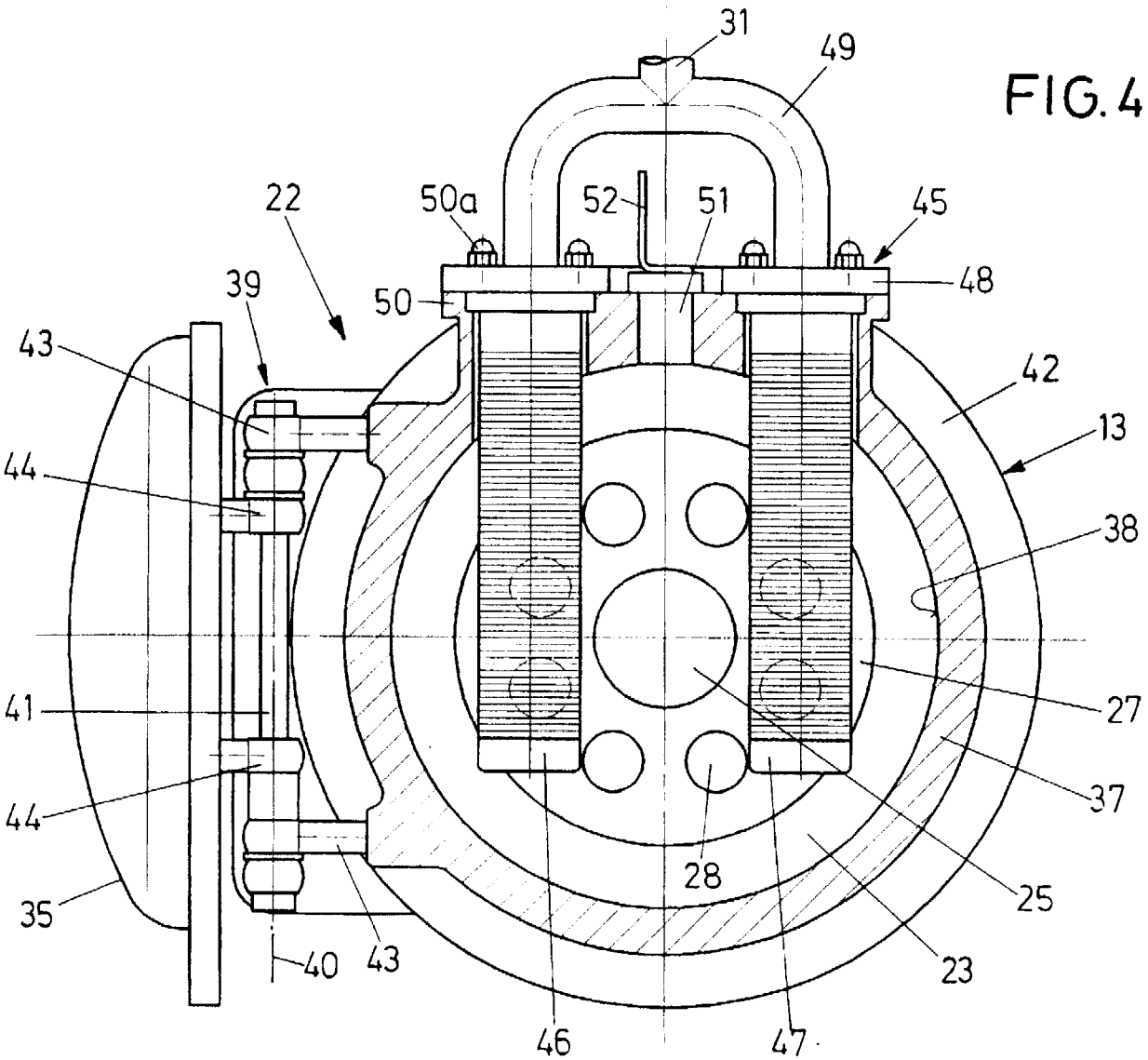
FIG. 4 is a view, partially broken open, of the bottom of the agitator mill according to the arrow IV of FIGS. 1, 2, 3 with the bottom cup pivoted off.

The embodiment according to FIGS. 1 to 5 deals with a so called horizontal agitator mill. It has a machine stand 1 which is substantially formed by a base plate and which supports itself on the ground 3 by means of props 2. A drive motor 4 speed-variable, if required, and provided with a V-belt pulley 5 is accommodated on this stand 1.

Beside the drive motor 4, provision is made on the stand 1 for a bearing housing 6, in which a drive shaft 7 is rotatably run in two bearings 8 that are spaced apart. The end of drive shaft 7 that is adjacent to the V-belt pulley 5 is likewise provided with a V-belt pulley 9 which, by way of V-belts 10, is in driving connection with V-belt pulley 5 of the drive motor 4. The V-belt pulleys 5, 9 and the V-belts 10 are provided with a cover 11.

At its end turned away from the V-belt pulley 9, the bearing housing 6 has an annular holding flange 12. The lid 14 of a cylindrical grinding receptacle 13 is mounted on this holding flange 12. To this end, threaded bolts 15 are mounted on the holding flange 12, passing through the lid 14 and a fastening flange 16 of the grinding receptacle. Fastening then takes place by means of nuts 17 screwed on the threaded bolts 15. The lid 14 is provided with a sealing casing 14*a*, in which the drive shaft 7 is sealed towards the grinding receptacle 13.

The cylindrical grinding receptacle 13 has a substantially cylindrical external cooling jacket 18 with ribs 20 that define a helically extending cooling passage 19. Inside, the grinding receptacle 13 has an inside wall 21, which is formed by a wearing bush and which defines the cooling passage 19 inwards and is replaceable. The inside wall 21 is not interrupted by outlets or the like.

The grinding receptacle 13 has a bottom 22 to be specified in detail below. An agitator 24 is disposed in an inner chamber of the grinding receptacle 13 that forms a grinding chamber 23 and has an over-mounted agitator shaft 25 that is joined against rotation to the drive shaft 7. This agitator shaft is provided with agitator elements 26 formed by agitator disks 27 with admission ports 28. The agitator shaft 25, the drive shaft 7 and the grinding receptacle 13 have a joint axis 29.

A grinding stock supply line 30 passes through the lid 14 to open into the grinding chamber 23. In the vicinity of the bottom 22, a grinding stock discharge line 31 discharges from the grinding chamber 23. A cooling water supply line 32 and a cooling water discharge line 33 are disposed on the cooling jacket 18, through which cooling water is supplied to, or discharged from, the cooling passage 19. The grinding chamber 23 is filled with auxiliary grinding bodies 34 to a considerable extent, for instance by 70 to 90 percent.

The bottom 22 is a multi-piece bottom. It has a bottom cup 25 as a lid-type closing piece, which is a dished head, i.e. it is substantially in the form of a calotte shell. This bottom cup 35 is provided with an annular bottom flange 36. Further, the bottom 22 has a ring section 37, the inside 38 of which is in alignment with the inside wall 21 of the grinding receptacle 13, continuing the latter as it were.

By means of a double hinge arrangement 39, the ring section 37 and the bottom cup 35 are pivotable in relation to the grinding receptacle 13 about a joint pivot axis 40. The joint vertical pivot axis 40 is formed by a pivot bolt 41, which is fastened to an annular sealing flange 42 of the grinding receptacle 13. It is on this pivot bolt 41 that the ring section 37 is supported by means of pivot links 43 and the bottom cup 35 by means of pivot links 44 to pivot about the pivot axis 40.

A separating device 45 is disposed in the ring section 37, the separating device 45, in this embodiment being formed by two so-called screen cartridges 46, 47, which are parallel to each other and project into the grinding chamber 23 on both sides of the agitator shaft 25 between the last agitator disk 27 disposed on the agitator shaft 25, and the bottom cup 35. The screen cartridges 46, 47 have a design as known for instance from U.S. Pat. No. 3,780,957 and U.S. Pat. No. 4,739,936. They may have a cylindrical cross-section as known from U.S. Pat. No. 3,780,957, or a flat oval cross-section as known from U.S. Pat. No. 4,739,936. The latter design can be seen in FIG. 2 where the cross-section is roughly outlined. In this case, the screen cartridges 46, 47 are disposed with their greatest cross-sectional dimension in a radial plane relative to the axis 29 and with their smallest cross-sectional dimension in the longitudinal direction of the axis 29.

The screen cartridges 46, 47 are inserted in the ring section 37 and externally covered by a covering plate 48, on which is mounted a C-shaped discharging connection piece 49 connecting the screen cartridges 46, 47 with the grinding stock discharge line 31. The covering plate 48 bears against a flange facing 50 mounted on the ring section 37, to which it is fixed by means of screws 50*a*. In the ring section 37, between the screen cartridges 46, 47, provision is made for a refill opening 51 for auxiliary grinding bodies 34, which is closable by means of a cap 52.

The agitator shaft 25 has an annexed piece 53, which runs between the two screen cartridges 46, 47 towards the bottom cup 35 and on the end of which a small circulation disk 54 is mounted, backing up the screen cartridges 46, 47 on the side of the bottom cup 35 and the diameter d of which being smaller than the diameter D of the agitator disks 27 so that it projects into the bottom cup 35.

Figure 5:
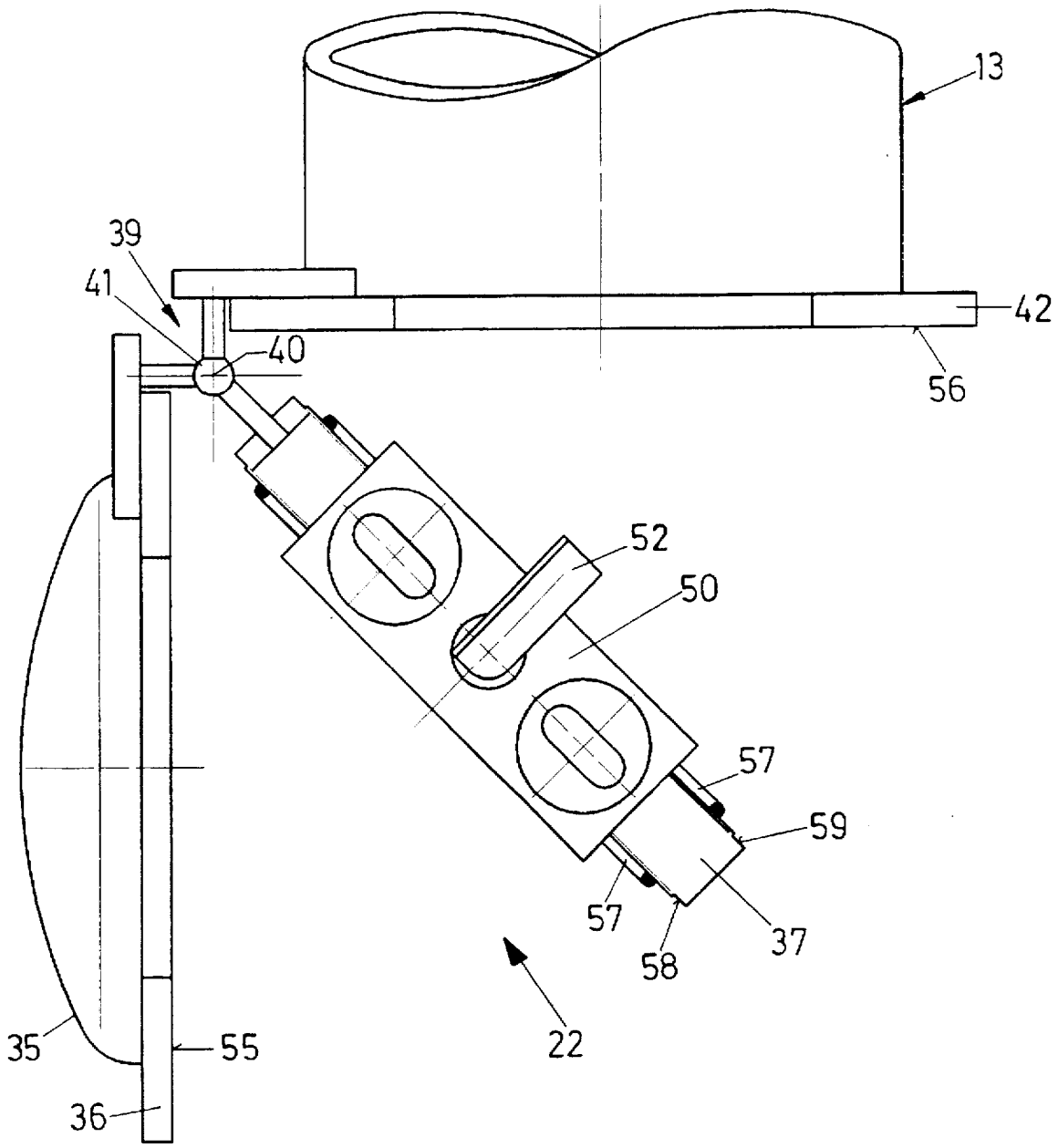
FIG. 5 is a plan view of the bottom portion of the agitator mill with the bottom opened and without the agitator in an illustration according to the arrow I of FIG. 2.

As seen in FIG. 5, plane, annular sealing faces 55, 56 are formed on the bottom flange 36 and the sealing flange 42 of the grinding receptacle 13, against which bear seals 57, in particular O-ring seals, when the bottom 22 is closed, the seals 57 being disposed in the front faces 58, 59, turned towards the two sealing faces 55, 56, of the ring section 37. Closing the bottom 22 is carried out by means of threaded bolts 60 that are pushed through the sealing flange 42 and the bottom flange 36 and are then provided with nuts 61. The threaded bolts 60 and the nuts 61 constitute a closing mechanism 62. In this way, the ring section 37 is clamped between the bottom flange 36 and the sealing flange 42, sealing simultaneously taking place by means of the seals 57 between the sealing faces 55, 56 on the one hand and the front faces 58, 59 on the other.

During operation of the agitator mill, grinding stock to be ground is conventionally pumped in the form of a suspension through the grinding stock supply line 30 into the grinding chamber 23 which is substantially filled with auxiliary grinding bodies. The grinding-stock/auxiliary-grinding-body suspension is subjected to intense impacts and shearing by the agitator 24 driven in rotation, this causing grinding and dispersing. The grinding stock ground and dispersed is discharged through the separating device 45, the screen cartridges 46, 47 keeping the auxiliary grinding bodies 34 back in the grinding chamber 23. The small circulation disk 54 that backs up the screen cartridge 46, 47 ensures that in the vicinity of the bottom cup 35, no dead spaces originate in which is formed a body of auxiliary grinding bodies 34 and grinding stock. Rather, permanent circulation and dispersion takes place so that ground grinding stock enters the screen cartridges 46, 47 also on the side of the bottom cup 35.

If for instance the grinding receptacle 13 is to be opened for cleaning, the separating device 45 is removed from the ring section 37, i.e. the covering plate 48 is removed and the screen cartridges 46, 47 are withdrawn. Then the closing mechanism 62 is opened and the bottom cup 35 and the ring section 37 is pivoted away from the grinding receptacle 13, as for instance seen in FIG. 5. The sealing faces 55, 56 and the associated front faces 58, 59 are bare and can be cleaned. The same applies to the inside of the bottom cup 35, the inside 38 of the ring section 37, the inside wall 21 of the grinding receptacle 13 and the latter's lid 14 and finally, to the agitator 24. Since the inside wall 21 of the grinding receptacle 31 has no openings or the like, it can easily be cleaned on the one hand and also easily be replaced on the other. This is of importance in particular when substances are used that have a strong wearing effect, so that the bush of wear-resistant material forming the inside wall 21 must be replaced from time to time, in which case it only has to be forced out of the cooling jacket 18 with the ribs 20.

Figure 6:
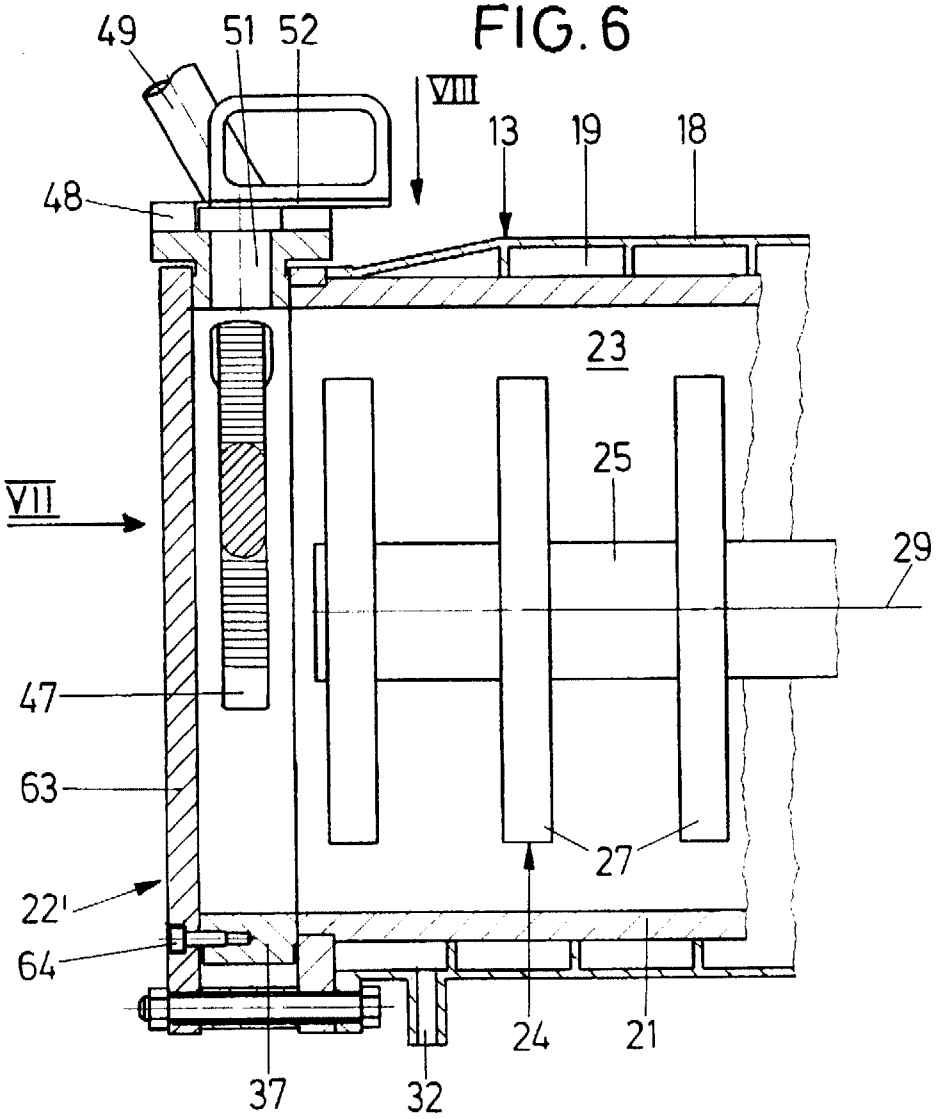
FIG. 6 is a vertical section of the bottom portion of a second embodiment of an agitator mill.
Figure 7:
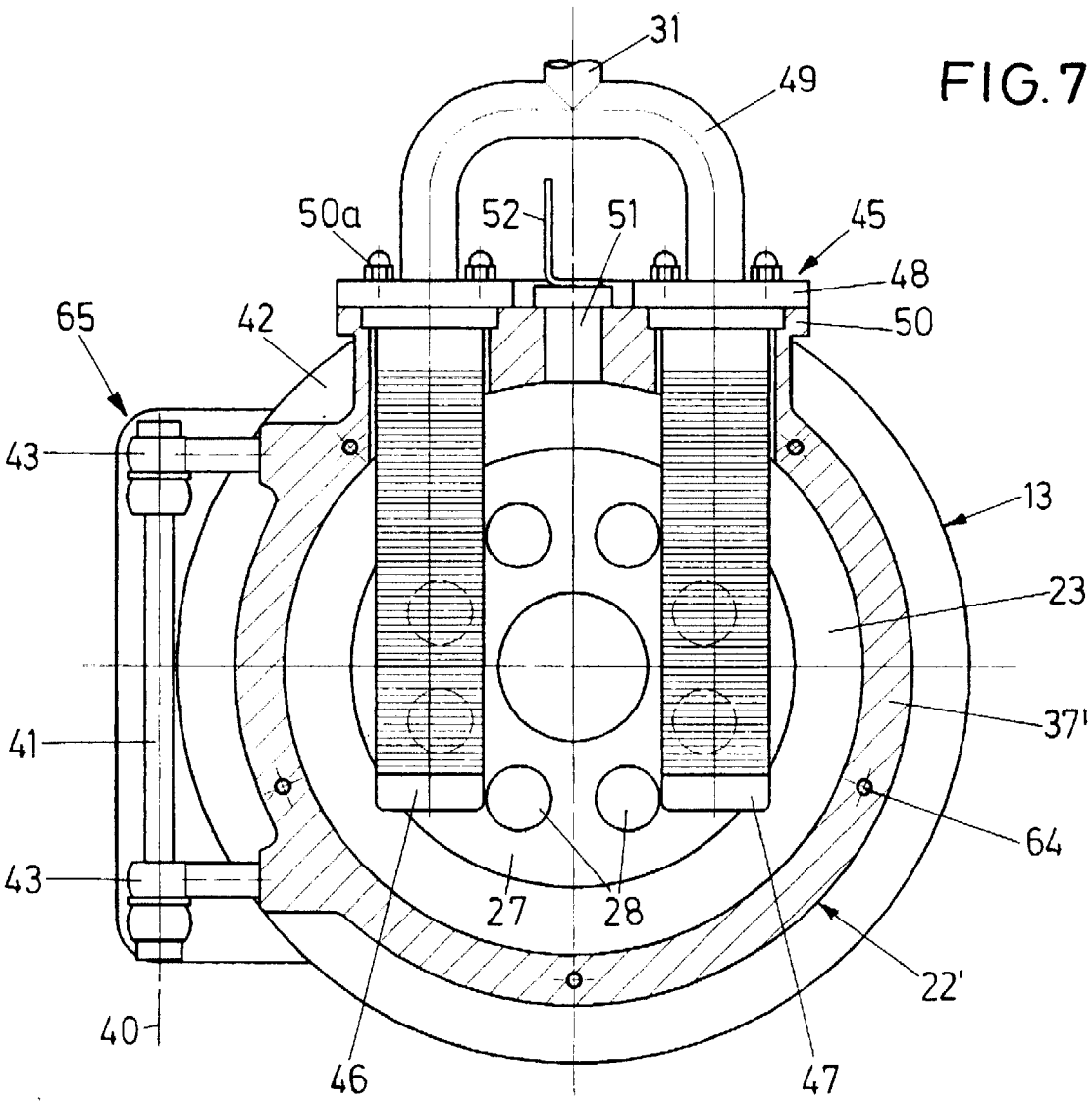
FIG. 7 is an illustration, according to the arrow VII of FIG. 6, of the second embodiment of an agitator mill with the bottom plate pivoted off.
Figure 8:
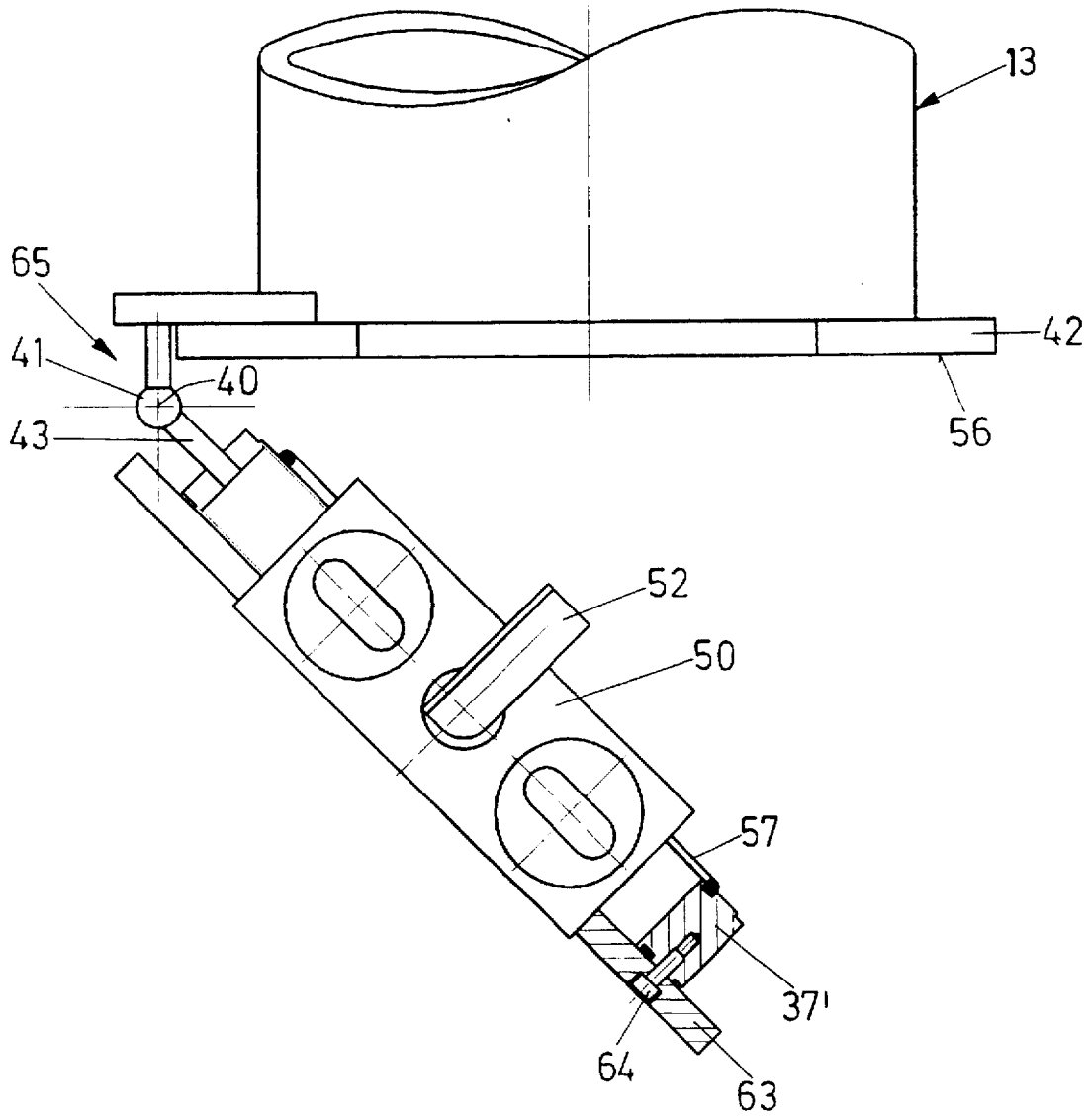
FIG. 8 is an illustration, according to the arrow VIII of FIG. 6, of the second embodiment of the agitator mill.

In the embodiment according to FIGS. 6 to 8, the bottom 22' comprises a plane bottom plate 63 as a lid-type closing piece, which is firmly, but detachably connected with the ring section 37' by means of screws 64. The ring section 37' is articulated to the grinding receptacle 13 by means of a simple hinge arrangement 65, there being only one pivot link 43. This design is only reasonable and sufficient in case the consistence, in particular the viscosity, of the material to be ground is such that no circulation disk backing up the screen cartridges 46, 47 is necessary. In this case, there is only a minor distance between the bottom plate 63 and the screen cartridges 46, 47, i.e. no substantial dead space. Otherwise, all components that are identical with those of the embodiment according to FIGS. 1 to 5 have the same reference numerals.

Figure 9:
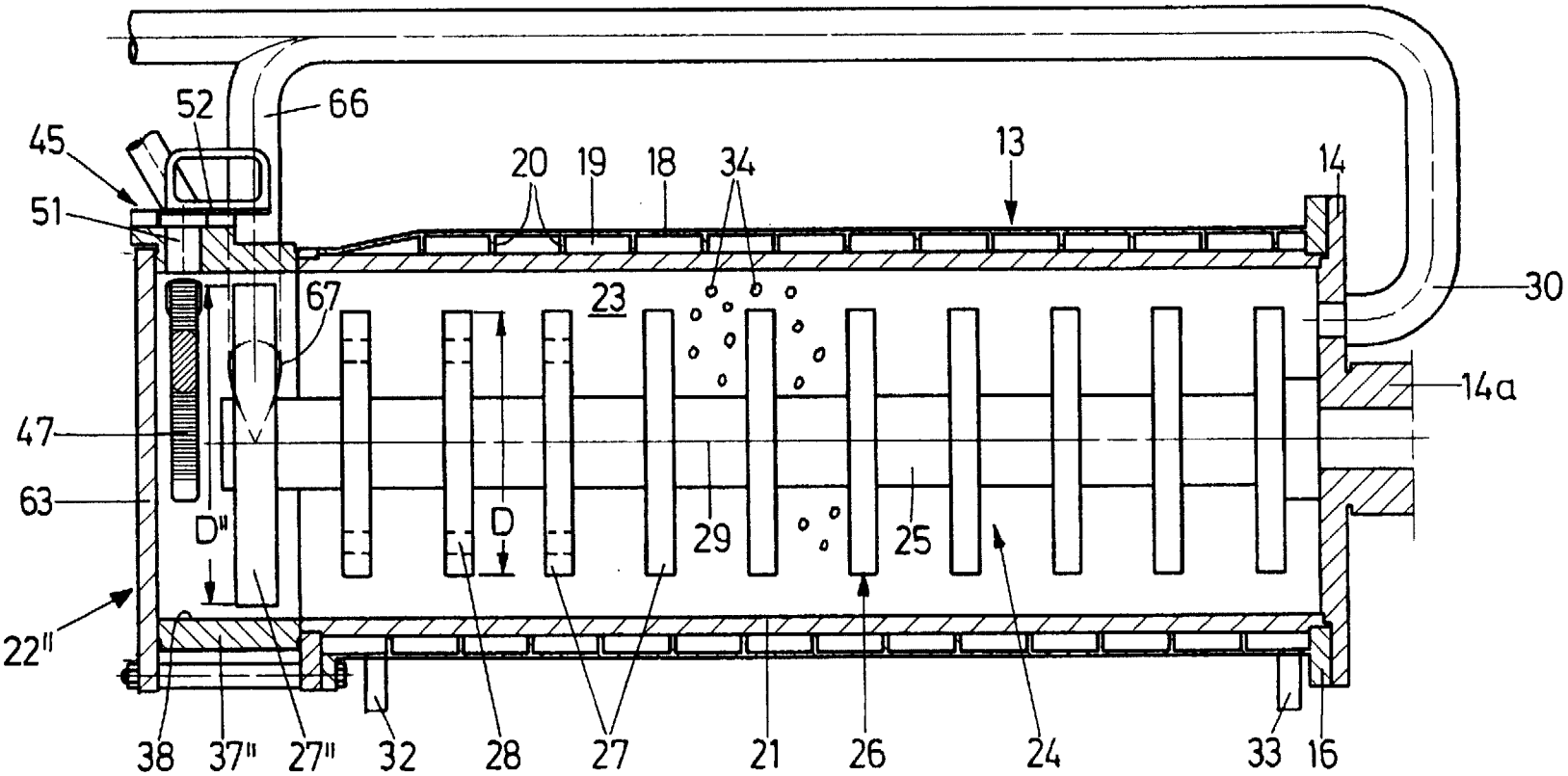
FIG. 9 is a vertical longitudinal section of a third embodiment of an agitator mill with an auxiliary grinding body return line.

In the embodiment according to FIG. 9, the bottom 22" comprises a bottom plate 63 same as with the embodiment according to FIGS. 6 to 8. The annular section 37" not only accommodates the separating device 45, but also an auxiliary-grinding-body return line 66, an auxiliary-grinding-body outlet 67 of which opening into the grinding chamber 23. This outlet 67 is level with the last agitator disk 27" of the agitator 24", which adjoins the separating device 45 and which exhibits a diameter D" that exceeds the diameter D of the agitator disks 27; this agitator disk 27" projects as far as into close vicinity to the inside 38 of the ring section 37" and overlaps the outlet 67 in the direction of the axis 29. The auxiliary-grinding-body return line 66 opens into the grinding-stock supply line 30 so that fresh grinding stock to be ground and auxiliary grinding bodies are jointly supplied to the grinding chamber 23 by means of the grinding-stock supply line 30. This principle is known from U.S. Ser. No. 08/519,020. The bottom 22" can be joined to the grinding receptacle 13 by a double hinge arrangement 39 or by a single hinge arrangement 65. Otherwise, all components described again have reference numerals as already used.

Figure 10:
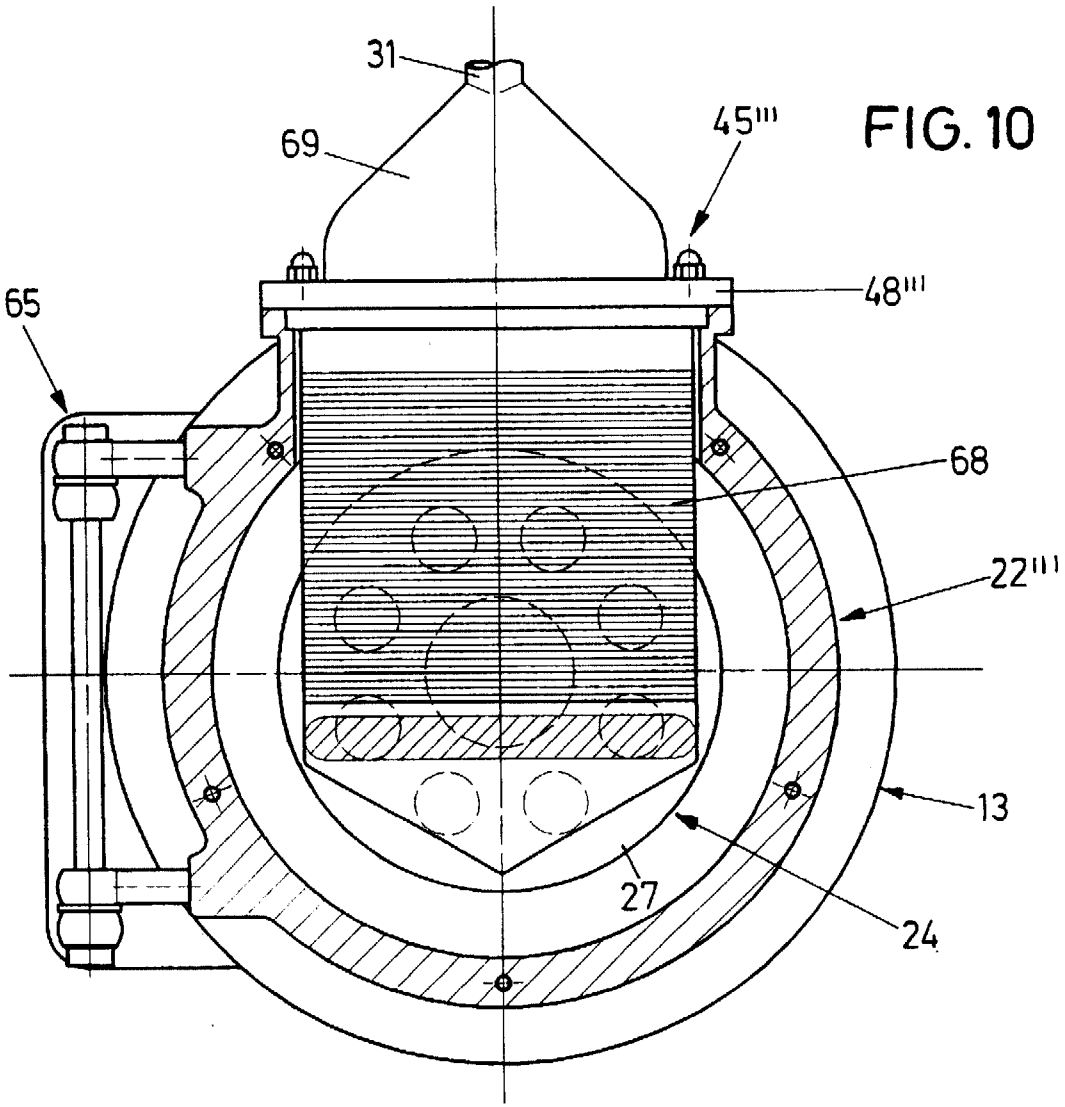
FIG. 10 is an illustration, according to FIG. 7, of a fourth embodiment of an agitator mill.

The embodiment according to FIG. 10 corresponds to that according to FIG. 6 to 8 with the difference that a separating device 45'" is disposed in the bottom 22'", consisting of a single, flat screen cartridge 68 of some width as compared to the screen cartridges 46, 47 and disposed between the agitator 24 and the bottom plate 63 not seen in FIG. 10. The cross-section of this screen cartridge 68 can likewise be seen in FIG. 10. The screen cartridge 68 is sufficiently rinsed from behind for no dead spaces to form between it and the bottom plate 63. In this case, the screen cartridge 68 is held by means of a covering plate 48" which exhibits a hopper-type connection piece 69 discharging into the grinding-stock discharge line 31. The bottom plate 63 cannot be pivoted off, there being provided only a single hinge arrangement 65.

Figure 11:
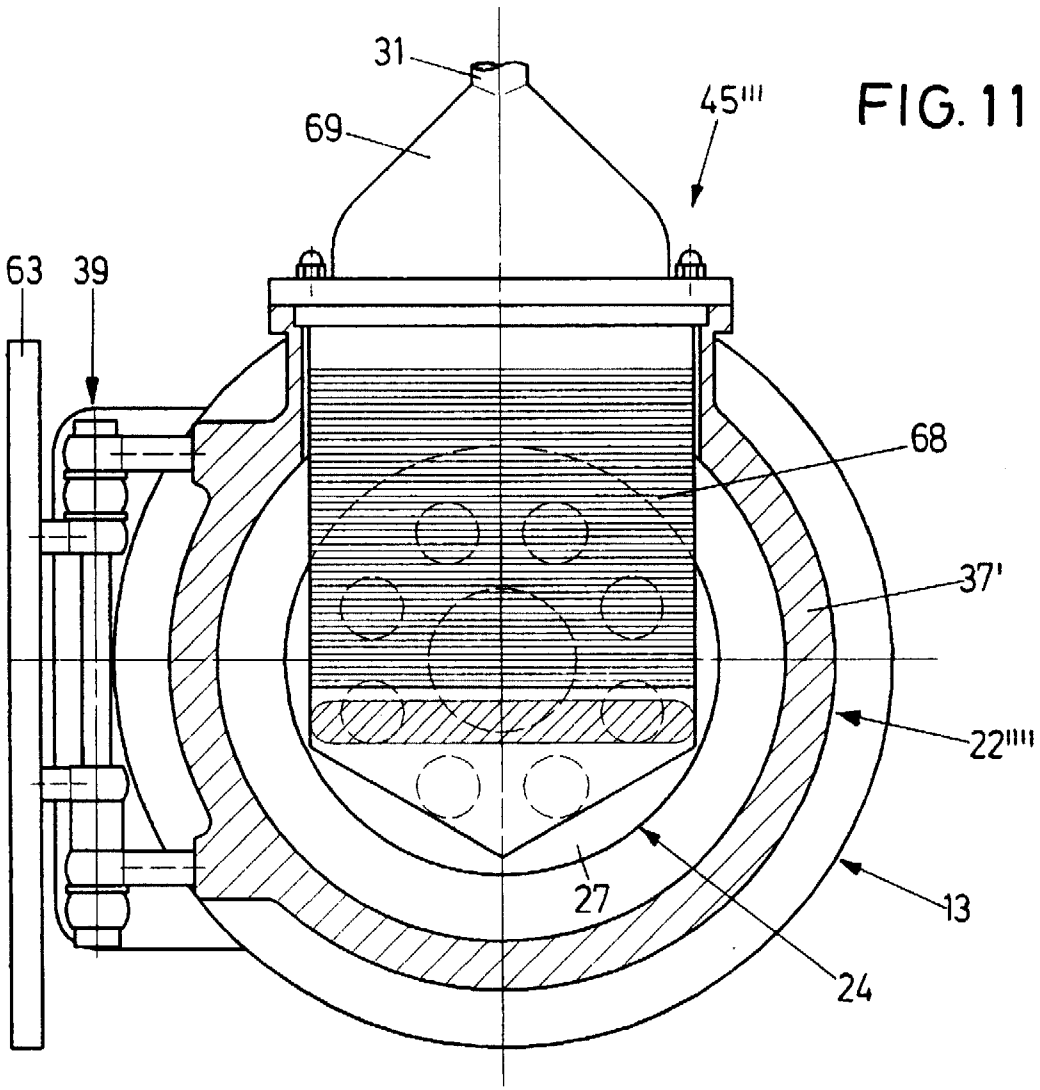
FIG. 11 is an illustration, according to FIG. 4, of a fifth embodiment of an agitator mill.

The embodiment according to FIG. 11 differs from that according to FIG. 10 in that a double hinge arrangement 39 is provided instead of a single hinge arrangement 65. Consequently, the bottom plate 63 and the ring section 37' of the bottom 22'" can individually be pivoted off the grinding receptacle 13.

What is claimed is:

1. An agitator mill comprising:

a grinding receptacle (13), of which a cylindrical wall (21) without any openings and a lid (14) and a bottom (22, 22', 22", 22'", 22"") define a grinding chamber (23) to be filled with auxiliary grinding bodies (34), an agitator (24), which is disposed in the grinding receptacle (13), and which has an agitator shaft (25) overmounted outside of the grinding chamber (23) and ending in a free end inside the grinding chamber (23), and agitator elements (26) mounted on the agitator shaft (25), said agitator having an axis (29), a drive motor (4) for driving the agitator in rotation about said axis (29), a grinding-stock supply line (30) disposed at least in vicinity to said lid (14) and opening into the grinding chamber (23), and a separating device (45, 45'") disposed in said bottom (22, 22', 22", 22'", 22""), a grinding-stock discharge line (31) connected to said separating device (45, 45'"), and a device for the releasable connection of the bottom (22, 22', 22", 22'", 22"") with the grinding receptacle (13), wherein the bottom (22, 22', 22", 22'", 22"") comprises a lid-type closing piece (35, 63) and a ring section (37, 37', 37"), which partly surrounds the separating device (45, 45'") and is disposed between the closing piece (35, 63) and the grinding receptacle (13).

2. An agitator mill according to claim 1, wherein a hinge arrangement (39, 65) permitting the bottom (22, 22', 22", 22'", 22"") to be pivoted off the grinding receptacle (13) and a closing mechanism (62) for the releasable connection of the bottom (22, 22', 22", 22'", 22"") with the grinding receptacle (13) are provided between the grinding receptacle (13) and the bottom (22, 22', 22", 22'", 22"").

3. An agitator mill according to claim 2, wherein a sealing face (56) and a seal (57) are provided at least between the bottom (22, 22', 22", 22'", 22"") and the grinding receptacle (13).

4. An agitator mill according to claim 1, wherein two pivot links (43, 44) are provided, which are formed as a double hinge arrangement (39).

5. An agitator mill according to claim 1, wherein a sealing face (56) and a seal (57) are provided between the lid-type closing piece (35, 63) and the ring section (37, 37', 37").

6. An agitator mill according to claim 1, wherein the separating device (45) is formed by screen cartridges (46, 47) which are disposed radially on both sides of the agitator shaft (25) and at right angles to the axis (29) of the agitator (24).

7. An agitator mill according to claim 6, wherein the agitator shaft (25) comprises an annexed piece (53), which passes between the screen cartridges (46, 47) in a direction towards the lid-type closing piece (35) and on which is mounted a circulation disk (54) disposed between the lid-type closing piece (35) and the screen cartridges (46, 47).

8. An agitator mill according to claim 7, wherein the lid-type closing piece is a bottom cup (35) partly surrounding the circulation disk (54).

9. An agitator mill according to claim 8, wherein the bottom cup (35) is a dished head.

10. An agitator mill according to claim 7, wherein the circulation disk (54) has a diameter d and wherein the agitator elements (26) have a diameter D and wherein D>d applies.

11. An agitator mill according to claim 1, wherein the separating device (45') comprises a screen cartridge (68), which is disposed between the agitator (24) and the lid-type closing piece (63).

12. An agitator mill according to claim 1, wherein an auxiliary-grinding-body return line (66) is provided, into which an auxiliary-grinding-body outlet (67) opens, which is formed in the ring section (37").

13. An agitator mill according to claim 12, wherein the auxiliary-grinding-body outlet (67) is disposed substantially in a plane extending radially to said axis (29) and common with the agitator (26), which is the last before the separating device (45, 45"') seen from the grinding-chamber (23).

14. An agitator mill according to claim 1, wherein a refill opening (51) for auxiliary grinding bodies (34) that is closable by means of a cap (52) is provided in the bottom (22, 22', 22", 22"', 22"").

15. An agitator mill comprising:

a grinding receptacle (13), of which a cylindrical wall (21) without any openings and a lid (14) and a bottom (22, 22', 22", 22"', 22"") define a grinding chamber (23) to be filled with auxiliary grinding bodies (34), an agitator (24), which is disposed in the grinding receptacle (13), and which has an agitator shaft (25) overmounted outside of the grinding chamber (23) and ending in a free end inside the grinding chamber (23), and agitator elements (26) mounted on the agitator shaft (25), said agitator having an axis (29), a drive motor (4) for driving the agitator in rotation about said axis (29), a grinding-stock supply line (30) disposed at least in vicinity to said lid (14) and opening into the grinding chamber (23), and a separating device (45, 45"') disposed in said bottom (22, 22', 22", 22"', 22"").

a grinding-stock discharge line (31) connected to said separating device (45, 45"'), and a device for the releasable connection of the bottom (22, 22', 22", 22"', 22"") with the grinding receptacle (13), wherein the bottom (22, 22', 22", 22"', 22"") comprises a lid-type closing piece (35, 63) and a ring section (37, 37', 37"), which partly surrounds the separating device (45, 45"') and is disposed between the closing piece (35, 63) and the grinding receptacle (13), wherein the lid-type closing (35, 63) and the ring section (37, 37") are independently pivotable.

16. An agitator mill according to claim 15, wherein a hinge arrangement (39, 65) permitting the bottom (22, 22', 22', 22"', 22"") to be pivoted off the grinding receptacle (13) and a closing mechanism (62) for the releasable connection of the bottom (22, 22', 22", 22"', 22"") with the grinding receptacle (13) are provided between the grinding receptacle (13) and the bottom (22, 22', 22", 22"', 22"").

17. An agitator mill according to claim 16, wherein a sealing face (56) and a seal (57) are provided at least between the bottom (22, 22', 22", 22"', 22"") and the grinding receptacle (13).

18. An agitator mill according to claim 15, wherein two pivot links (43, 44) are provided, which are formed as a double hinge arrangement (39).

19. An agitator mill according to claim 15, wherein a sealing face (56) and a seal (57) are provided between the lid-type closing piece (35, 63) and the ring section (37, 37', 37").

20. An agitator mill according to claim 15, wherein the separating device (45) is formed by screen cartridges (46, 47) which are disposed radially on both sides of the agitator shaft (25) and at right angles to the axis (29) of the agitator (24).

21. An agitator mill according to claim 20, wherein the agitator shaft (25) comprises an annexed piece (53), which passes between the screen cartridges (46, 47) in a direction towards the lid-type closing piece (35) and on which is mounted a circulation disk (54) disposed between the lid-type closing piece (35) and on which is mounted a circulation disk (54) disposed between the lid-type closing piece (35) and the screen cartridges (46, 47).

22. An agitator mill according to claim 21, wherein the lid-type closing piece is a bottom cup (35) partly surrounding the circulation disk (54).

23. An agitator mill according to claim 22, wherein the bottom cup (35) is a dished head.

24. An agitator mill according to claim 21, wherein the circulation disk (54) has a diameter d and wherein the agitator elements (26) have a diameter D and wherein D>d applies.

25. An agitator mill according to claim 15, wherein the separating device (45"') comprises a screen cartridge (68), which is disposed between the agitator (24) and the lid-type closing piece (63).

26. An agitator mill according to claim 15, wherein an auxiliary-grinding-body return line (66) is provided, into which an auxiliary-grinding-body outlet (67) opens, which is formed in the ring section (37").

27. An agitator mill according to claim 26, wherein the auxiliary-grinding-body outlet (67) is disposed substantially in a plane extending radially to said axis (29) and common with the agitator (26), which is the last before the separating device (45, 45"') seen from the grinding-chamber (23).

28. An agitator mill according to claim 15, wherein a refill opening (51) for auxiliary grinding bodies (34) that is closable by means of a cap (52) is provided in the bottom (22, 22', 22", 22"', 22"").

29. An agitator mill comprising:

a grinding receptacle (13), of which a cylindrical wall (21) without any openings and a lid (14) and a bottom (22, 22', 22", 22"', 22"") define a grinding chamber (23) to be filled with auxiliary grinding bodies (34), an agitator (24), which is disposed in the grinding receptacle (13), and which has an agitator shaft (25) overmounted outside of the grinding chamber (23) and ending in a free end inside the grinding chamber (23), and agitator elements (26) mounted on the agitator shaft (25), said agitator having an axis (29), a drive motor (4) for driving the agitator in rotation about said axis (29), a grinding-stock supply line (30) disposed at least in vicinity to said lid (14) and opening into the grinding chamber (23), and a separating device (45, 45''') disposed in said bottom (22, 22', 22'', 22''', 22'''').

a grinding-stock discharge line (31) connected to said separating device (45, 45'''), and a device for the releasable connection of the bottom (22, 22', 22'', 22''', 22'''') with the grinding receptacle (13), wherein the bottom (22, 22', 22'', 22''', 22'''') comprises a lid-type closing piece (35, 63) and a ring section (37, 37', 37''), which partly surrounds the separating device (45, 45''') and is disposed between the closing piece (35, 63) and the grinding receptacle (13), wherein the ring section (37) is joined to the grinding receptacle (13) by means of a pivot link (43) and the lid-type closing piece (63) is firmly but detachably connected with the ring section (37).

30. An agitator mill according to claim 15, wherein a hinge arrangement (39, 65) permitting the bottom (22, 22', 22', 22''', 22'''') to be pivoted off the grinding receptacle (13) and a closing mechanism (62) for the releasable connection of the bottom (22, 22', 22'', 22''', 22'''') with the grinding receptacle (13) are provided between the grinding receptacle (13) and the bottom (22, 22', 22'', 22''', 22'''').

31. An agitator mill according to claim 30, wherein a sealing face (56) and a seal (57) are provided at least between the bottom (22, 22', 22'', 22''', 22'''') and the grinding receptacle (13).

32. An agitator mill according to claim 29, wherein a sealing face (56) and a seal (57) are provided between the lid-type closing piece (35, 63) and the ring section (37, 37', 37'').

33. An agitator mill according to claim 29, wherein the separating device (45) is formed by screen cartridges (46, 47) which are disposed radially on both sides of the agitator shaft (25) and at right angles to the axis (29) of the agitator (24).

34. An agitator mill according to claim 33, wherein the agitator shaft (25) comprises an annexed piece (53), which passes between the screen cartridges (46, 47) in a direction towards the lid-type closing piece (35) and on which is mounted a circulation disk (54) disposed between the lid-type closing piece (35) and on which is mounted a circulation disk (54) disposed between the lid-type closing piece (35) and the screen cartridges (46, 47).

35. An agitator mill according to claim 34, wherein the lid-type closing piece is a bottom cup (35) partly surrounding the circulation disk (54).

36. An agitator mill according to claim 35, wherein the bottom cup (35) is a dished head.

37. An agitator mill according to claim 34, wherein the circulation disk (54) has a diameter d and wherein the agitator elements (26) have a diameter D and wherein D>d applies.

38. An agitator mill according to claim 29, wherein the separating device (45''') comprises a screen cartridge (68), which is disposed between the agitator (24) and the lid-type closing piece (63).

39. An agitator mill according to claim 29, wherein an auxiliary-grinding-body return line (66) is provided, into which an auxiliary-grinding-body outlet (67) opens, which is formed in the ring section (37'').

40. An agitator mill according to claim 39, wherein the auxiliary-grinding-body outlet (67) is disposed substantially in a plane extending radially to said axis (29) and common with the agitator (26), which is the last before the separating device (45, 45''') seen from the grinding-chamber (23).

41. An agitator mill according to claim 29, wherein a refill opening (51) for auxiliary grinding bodies (34) that is closable by means of a cap (52) is provided in the bottom (22, 22', 22'', 22''', 22'''').

42. An agitator mill comprising:

a grinding receptacle (13), of which a cylindrical wall (21) without any openings and a lid (14) and a bottom (22, 22', 22'', 22''', 22'''') define a grinding chamber (23) to be filled with auxiliary grinding bodies (34), an agitator (24), which is disposed in the grinding receptacle (13), and which has an agitator shaft (25) overmounted outside of the grinding chamber (23) and ending in a free end inside the grinding chamber (23), and agitator elements (26) mounted on the agitator shaft (25), said agitator having an axis (29), a drive motor (4) for driving the agitator in rotation about said axis (29), a grinding-stock supply line (30) disposed at least in vicinity to said lid (14) and opening into the grinding chamber (23), and a separating device (45, 45''') disposed in said bottom (22, 22', 22'', 22''', 22'''').

a grinding-stock discharge line (31) connected to said separating device (45, 45'''), and a device for the releasable connection of the bottom (22, 22', 22'', 22''', 22'''') with the grinding receptacle (13), wherein the bottom (22, 22', 22'', 22''', 22'''') comprises a lid-type closing piece (35, 63) and a ring section (37, 37', 37''), which partly surrounds the separating device (45, 45''') and is disposed between the closing piece (35, 63) and the grinding receptacle (13), wherein the ring section (37) comprises at least one of an opening receiving the separating device (45) and an auxiliary-grinding body outlet (67) and a refill opening (51) for auxiliary-grinding bodies (34).

* * * * *